US011402863B2

(12) United States Patent
Tomioka

(10) Patent No.: US 11,402,863 B2
(45) Date of Patent: Aug. 2, 2022

(54) REFERENCE VOLTAGE CIRCUIT

(71) Applicant: ABLIC Inc., Tokyo (JP)

(72) Inventor: Tsutomu Tomioka, Tokyo (JP)

(73) Assignee: ABLIC INC., Tokyo (JP)

( * ) Notice: Subject to any disclaimer, the term of this patent is extended or adjusted under 35 U.S.C. 154(b) by 0 days.

(21) Appl. No.: 16/931,005

(22) Filed: Jul. 16, 2020

(65) Prior Publication Data

US 2021/0034092 A1 Feb. 4, 2021

(30) Foreign Application Priority Data

Jul. 29, 2019 (JP) ..... JP2019-138412

(51) Int. Cl.
*G05F 3/24* (2006.01)
*G05F 3/18* (2006.01)
*G05F 3/26* (2006.01)

(52) U.S. Cl.
CPC ..... *G05F 3/242* (2013.01); *G05F 3/185* (2013.01); *G05F 3/262* (2013.01)

(58) Field of Classification Search
CPC ..... G05F 3/185; G05F 3/242; G05F 3/262
See application file for complete search history.

(56) References Cited

U.S. PATENT DOCUMENTS 3,916,508 A 11/1975 Conzelmann et al.
6,806,749 B2 * 10/2004 Drusenthal ..... H03K 17/223 327/143
7,071,672 B2 * 7/2006 Drusenthal ..... G05F 1/46 323/314
7,554,311 B2 * 6/2009 Pan ..... G11C 5/145 323/275
8,461,912 B1 * 6/2013 Kumar ..... G05F 3/30 327/539
8,575,999 B2 * 11/2013 Akiya ..... G05F 3/242 327/543
2004/0041622 A1 * 3/2004 Wu ..... G05F 3/262 327/538

FOREIGN PATENT DOCUMENTS

JP S49-128250 12/1974

* cited by examiner

*Primary Examiner* — Diana J. Cheng
*Assistant Examiner* — Colleen J O Toole
(74) *Attorney, Agent, or Firm* — Crowell & Moring LLP

(57) ABSTRACT

Provided is a reference voltage circuit including a Zener diode having a cathode connected to a current source via a first node, and an anode connected to a ground point; a first resistor having one end connected to the first node; a second resistor having one end connected to another end of the first resistor; a first diode having an anode connected to another end of the second resistor via a second node, and a cathode connected to the ground point; and a current control circuit configured to generate a control current corresponding to an anode voltage of the first diode so that the current source supplies a reference current corresponding to the control current to the first diode.

20 Claims, 7 Drawing Sheets

REFERENCE VOLTAGE CIRCUIT

RELATED APPLICATIONS

This application claims priority to Japanese Patent Application No. 2019-138412, filed on Jul. 29, 2019, the entire content of which is incorporated herein by reference.

BACKGROUND OF THE INVENTION

1. Field of the Invention

The present invention relates to a reference voltage circuit.

2. Description of the Related Art

Hitherto, a reference voltage circuit has been widely used in an electronic circuit in which the reference voltage circuit generates a reference voltage used as a threshold voltage in a comparator, which compares a given voltage with the threshold voltage.

A configuration including a Zener diode, a diode, and resistors can be employed in the reference voltage circuit because a reference voltage can be generated from a simple configuration (see, for example, Japanese Patent Application Laid-Open No. S49-128250).

In a conventional reference voltage circuit 100 illustrated in FIG. 7, between an output terminal of a constant current source 103 and the ground point, a Zener diode 104 and a series circuit of resistors 107 and 106 and a diode 105 are connected in parallel in which the Zener diode 104 is connected in a reverse direction and the diode 105 is connected in a forward direction.

The reference voltage circuit 100 thereby supplies an output voltage Vout for a reference voltage from a connection point between the resistors 107 and 106.

In the reference voltage circuit 100, the output voltage Vout is given by Equation (A1).

$$Vout=(R_{106}\cdot V_z+R_{107}\cdot V_D)/(R_{106}+R_{107}) \quad \text{(A1)}$$

In Equation (A1) above, $V_z$ is a voltage at a cathode of the Zener diode 104, $V_D$ is a voltage at an anode of the diode 105, and $R_{106}$ and $R_{107}$ are resistance of the resistors 106 and 107, respectively.

Further, the current $I_{105}$ flowing through the diode 105 is given by Equation (A2).

$$I_{105}=(V_z-V_D)/(R_{106}+R_{107}) \quad \text{(A2)}$$

In Equation (A2), the voltage $V_z$ has a positive temperature coefficient, and the voltage $V_D$ has a negative temperature coefficient.

If temperature coefficients of the resistors 106 and 107 are 0 (if the resistors 106 and 107 have no temperature dependence), the current $I_{105}$ has a positive temperature coefficient.

When the current supplied by the constant current source 103 is denoted by $I_{103}$, the current $I_{104}$ flowing through the Zener diode 104 is given by Equation (A3).

$$I_{104}=I_{103}-I_{105} \quad \text{(A3)}$$

When the current $I_{103}$ has no temperature dependence, since the current $I_{105}$ has a positive temperature coefficient, the current $I_{104}$ has a negative temperature coefficient.

That is, as the current $I_{105}$ increases in accordance with temperature rise while the current $I_{103}$ does not change, the current $I_{104}$ relatively decreases. Thus, in the case of the reference voltage circuit 100, since the current $I_{104}$ decreases in accordance with the temperature rise, the linearity of the voltage $V_z$ with respect to the temperature change cannot be maintained.

To the contrary, even in a case where the current $I_{105}$ increases by the temperature rising, the linearity of the voltage $V_z$ with respect to the temperature change can be maintained, and the temperature coefficient of the output voltage Vout can be brought to 0 by increasing the current $I_{103}$ in order to reduce the influence of the negative temperature coefficient of the voltage $V_D$.

However, in order to maintain the linearity of the voltage $V_z$, constant flow of the current $I_{103}$ which is large enough to reduce the influence of the negative temperature coefficient of the voltage $V_D$ should be supplied through the Zener diode 104 as a bias current, making the reduction of the power consumption of the reference voltage circuit difficult.

SUMMARY OF THE INVENTION

The present invention has an object to provide a reference voltage circuit capable of maintaining a linearity of a temperature dependence of the voltage applied to the cathode of the Zener diode without increasing the current flowing from a constant current source to the Zener diode, and thus capable of saving power through reduction of power consumption.

According to an embodiment of the present invention, a reference voltage circuit includes a Zeller diode having a cathode connected to a current source via a first node, and an anode connected to a ground point; a first resistor having one end connected to the first node; a second resistor having one end connected to another end of the first resistor; a first diode having an anode connected to another end of the second resistor via a second node, and a cathode connected to the ground point; and a current control circuit which generates a control current corresponding to an anode voltage of the first diode so that the current source to supplies a reference current corresponding to the control current to the first diode.

According to the reference voltage circuit of the present invention, the reference voltage circuit capable of maintaining the linearity of the temperature dependence of the voltage applied to the cathode of the Zener diode without increasing the current flowing from the constant current source to the Zener diode, and thus capable of saving power through reduction of power consumption can be provided.

DETAILED DESCRIPTION OF THE PREFERRED EMBODIMENTS

Now, description is given of embodiments of the present invention with reference to the drawings.

First Embodiment

Figure 1:
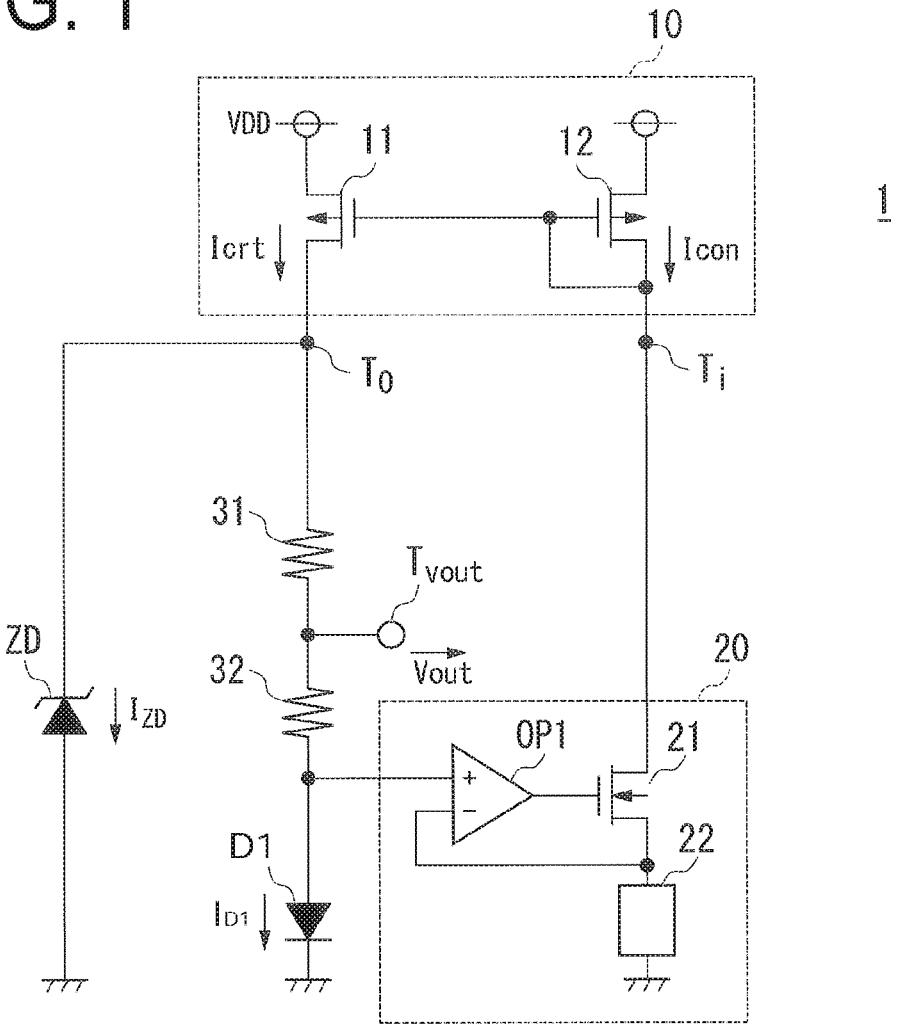
FIG. 1 is a circuit diagram illustrating a configuration example of a reference voltage circuit according to a first embodiment of the present invention.

FIG. 1 is a circuit diagram illustrating a configuration example of a reference voltage circuit according to the first embodiment of the present invention.

A reference voltage circuit 1 includes a current mirror circuit 10, a current control circuit 20, a resistor 31 (first resistor), a resistor 32 (second resistor), a Zener diode ZD, and a diode D1.

The current mirror circuit 10 includes p-channel transistors 11 and 12. A drain of the transistor 11 is connected to an output terminal To, and a drain of the transistor 12 is connected to an input terminal Ti.

The current control circuit 20 is a current source in the reference voltage circuit 1, and includes an error amplifier circuit OP1, a transistor 21, and a V/I conversion element 22.

The Zener diode ZD has a cathode connected to the output terminal To of the current mirror circuit 10, and an anode connected to the ground point.

The resistor 31 has one end connected to the cathode of the Zener diode ZD, and the other end connected to one end of the resistor 32 and an output terminal Tvout. The other end of the resistor 32 is connected to the anode of the diode D1. The cathode of the diode D1 is connected to the ground point.

The transistor 21 is an n-channel transistor. The transistor 21 includes a drain connected to the input terminal Ti of the current mirror circuit 10, a gate connected to an output terminal of the error amplifier circuit OP1, and a source connected to one end of the V/I conversion element 22.

The error amplifier circuit OP1 includes a non-inverting input terminal connected to the anode of the diode D1, and an inverting input terminal connected to the one end of the V/I conversion element 22.

The other end of the V/I conversion element 22 is connected to the ground point to convert a voltage $V_D$ of the diode D1 into a control current $I_{con}$.

Figure 2:
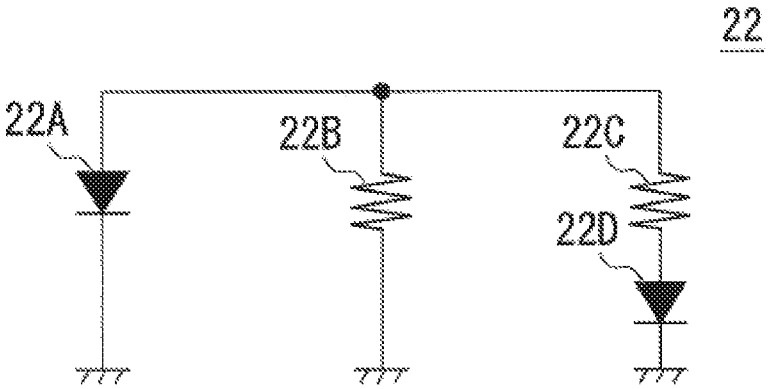
FIG. 2 is a circuit diagram illustrating an example of a V/I conversion element.

FIG. 2 is a circuit diagram illustrating an example of the V/I conversion element. In FIG. 2, the V/I conversion element 22 includes a diode 22A, a resistor 22B, a resistor 22C, and a diode 22D.

Between the one end and the other end of the V/I conversion element 22, the diode 22A, the resistor 22B, and a series circuit including the resistor 22C and the diode 22D are connected in parallel. In this case, the diodes 22A and 22D are connected in a forward direction along the one end to the other end of the V/I conversion element 22.

In the reference voltage circuit 1, when the sources of the transistors 11 and 12 are applied with a power supply voltage VDD, the output voltage Vout is supplied from the output terminal Tvout.

At this time, a current $I_{ZD}$ flowing through the Zener diode ZD generates a voltage $V_Z$ as a reverse voltage at the cathode of the Zener diode ZD. Further, a current $I_{D1}$ flowing through the diode D1 generates a voltage $V_D$ as a forward voltage at the anode of the diode D1.

The output voltage Vout is determined in accordance with the voltage $V_Z$, the voltage $V_D$, and a voltage dividing ratio of the resistors 31 and 32. In Equation (1) below, the resistance of the resistors 31 and 32 are $R_{31}$ and $R_{32}$, respectively.

$$Vout=(R_{32}\cdot V_Z+R_{31}\cdot V_D)/(R_{31}+R_{32}) \quad (1)$$

Then, the voltage $V_Z$ of the Zener diode ZD is adjusted to have a positive temperature coefficient so as to balance with the negative temperature coefficient of the voltage $V_D$ of the diode D1 so that the output voltage Vout of the reference voltage circuit 1 has no temperature dependence temperature coefficient is zero). The resistance $R_{31}$ and $R_{32}$ of the resistors 31 and 32 are thus set to satisfy Equation (2) below in a case where the current $I_{ZD}$ flowing through the Zener diode ZD is supplied as a bias current.

$$R_{32}\cdot(dV_Z/dT)+R_{31}\cdot(dV_D/dT)=0 \quad (2)$$

In Equation (2) above, $(dV_Z/dT)$ represents an amount of change of the cathode voltage $V_Z$ per unit temperature change and has a positive temperature coefficient. Further, $(dV_D/dT)$ represents an amount of change of the voltage $V_D$ per unit temperature change and has a negative temperature coefficient.

The current control circuit 20 functions as a V/I converter circuit which converts the voltage $V_D$ of the diode D1 into a corresponding control current $I_{con}$.

That is, the error amplifier circuit OP1 causes the transistor 21 to perform negative feedback processing so that the voltage drop of the V/I conversion element 22 becomes equal to the voltage $V_D$. The control current $I_{con}$ corresponding to the voltage $V_D$ thus flows through the V/I conversion element 22 from the input terminal Ti of the current mirror circuit 10.

The control current $I_{con}$ is a combined current of currents flowing through the diode 22A, the resistor 22B, and the series connection of the resistor 22C and the diode 22D.

In this case, through the diode 22A, there flows a current $I_{22A}$ which is determined by the area ratio (area ratio of P/N junction) between the diode 22A and the diode D1 and is proportional to the current $I_{D1}$. The voltage drop of the diode 22A has a negative temperature coefficient.

Further, through the resistor 22B, a current $I_{22B}$ ($=V_D/R_{22B}$) proportional to the voltage $V_D$ of the diode D1 flows. $R_{22B}$ is a resistance of the resistor 22B. The current $I_{22B}$ has a negative temperature coefficient.

Through the resistor 22C and the diode 22D, a current $I_{22C}$ ($=\Delta V_D/R_{22C}$) proportional to the difference voltage $\Delta V_D$ between the anode voltage of the diode D1 and the anode voltage of the diode 22D flows. $R_{22C}$ is a resistance of the resistor 22C. The difference voltage $\Delta V_D$ has a positive temperature coefficient.

In response to an input of the control current $I_{con}$ to the input terminal Ti from the current control circuit 20, the current mirror circuit 10 supplies a reference current $I_{crt}$ to the Zener diode ZD and the diode D1 from the output terminal To in accordance with the predetermined mirror ratio. For example, in a case where the mirror ratio of the output current with respect to the input current is K, the reference current $I_{crt}$ is given by Equation (3) below.

$$I_{crt}=K\cdot(I_{22A}+I_{22B}+I_{22C}) \quad (3)$$

For example, in a case where the area ratio between the diode D1 and the diode 22A is 1:1, the area ratio between the diode at and the diode 22D is 1:N (>1, for example, 2 or more), and K=1 holds, the reference current $I_{crt}$ is given by Equation (4) below.

$$I_{crt}=I_{22A}+V_D/R_{22B}+\Delta V_D/R_{22C} \quad (4)$$

where $I_{22A}=I_{D1}$ holds.

In Equation (4), the first term $I_{22A}$ is a current flowing through the diode 22A having a characteristic similar to that of the diode D1 and is the same as the current $I_{D1}$ flowing through the diode D1. The current $I_{D1}$ is supplied from the output terminal To of the current mirror circuit 10 to the diode D1 as a feedback corresponding to the voltage $V_D$.

Thus, the second term $V_D/R_{22B}$ and the third term $\Delta V_D/R_{22C}$ are currents supplied from the output terminal To of the current mirror circuit 10 to the Zener diode ZD.

The current $I_{ZD}$ flowing through the Zener diode ZD is given by Equation (5) which is obtained by excluding the first term from Equation (4).

$$I_{ZD}=V_D/R_{22B}+\Delta V_D/R_{22C} \quad (5)$$

As is understood from Equation (5) above, the first term and the second term represent currents flowing through the resistor 22B and the series circuit of the resistor 22C and the diode 22D, respectively, and are thus not affected by the current $I_{D1}$ flowing through the diode D1.

Further, in a case where the temperature coefficients of the resistors 22B and 22C are zero, the temperature coefficient of the current $V_D/R_{22B}$ is negative because the voltage $V_D$ has a negative temperature coefficient, and the temperature coefficient of the current $\Delta V_D/R_{22C}$ is positive because the difference voltage $\Delta V_D$ has a positive temperature coefficient. Thus, through adjustment of the resistance $R_{22B}$ of the resistor 22B and the resistance $R_{22C}$ of the resistor 22C, the temperature characteristic of the current $I_{ZD}$ flowing through the Zener diode ZD can be arbitrarily adjusted to be positive or negative.

As described above, the reference voltage circuit 1 generates the control current $I_{con}$ by combining the current corresponding to the voltage $V_D$ and the current corresponding to the current $I_{ZD}$ flowing through the Zener diode ZD, supplies the reference current $I_{crt}$ from the current mirror circuit 10 in accordance with the control current $I_{con}$, and adjusts the currents $I_{D1}$ and $I_{ZD}$ in accordance with the temperature change.

As described above, in accordance with variation that is based on the temperature dependence of each of the voltage $V_D$ and the voltage $V_Z$, the current $I_{D1}$ which compensates this variation is supplied to flow through the diode D1, and the current $I_{ZD}$ is supplied to flow through the Zener diode ZD, permitting arbitrary control of the voltage $V_Z$.

Since the reference voltage circuit 1 is capable of supplying the current $I_{ZD}$ in response to the temperature change with adjustment to the minimum necessary current amount, the reference voltage circuit 1 is thus capable of saving power while maintaining the linearity of the temperature dependence of the voltage $V_Z$ applied to the cathode of the Zener diode ZD.

The reference voltage circuit 1 may include a start-up circuit (not shown) to apply a predetermined pulse current to the resistor 31 at the time of start-up.

Further, the V/I conversion element 22 has been described as a configuration including the diode 22A, the resistor 22B, the resistor 22C, and the diode 22D, but the V/I conversion element 22 may be a configuration including any one of the diode 22A, the resistor 22B, and the series circuit of the resistor 22C and the diode 22D, or a combination thereof. In the case of such configuration, in order to maintain the linearity of the cathode voltage $V_Z$, the mirror ratio of the current mirror circuit 10, the area ratios of the diodes 22A and 22D, and the resistances of the resistors 22B and 22C are adjusted, and the control current $I_{con}$ is generated from the voltage $V_D$ so that the sum of the currents $I_{D1}$ and $I_{ZD}$ become the current $I_{crt}$ that is adjusted as appropriate in accordance with the temperature change.

Figure 3:
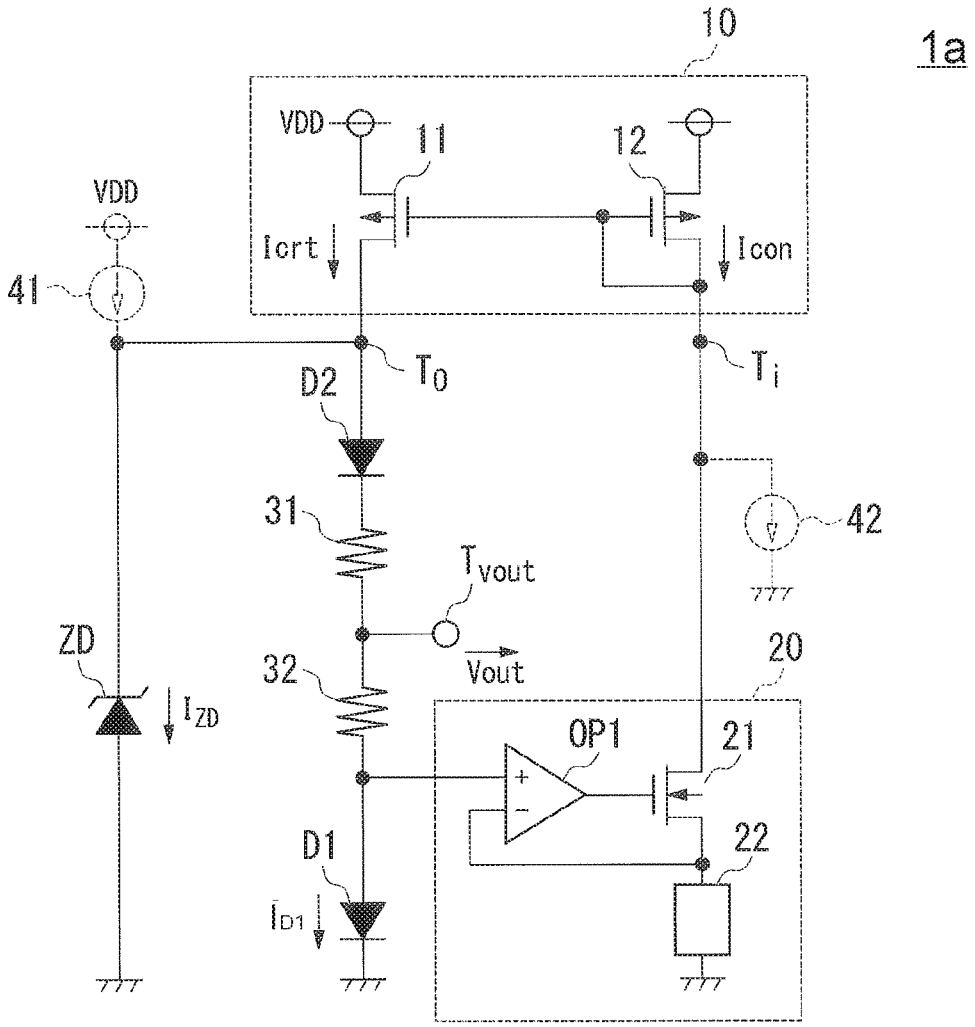
FIG. 3 is a circuit diagram illustrating a modification example of the reference voltage circuit according to the first embodiment.

FIG. 3 is a circuit diagram illustrating a modification example of the reference voltage circuit according to the first embodiment. Configurations and operations different from those of the reference voltage circuit 1 of FIG. 1 are described below.

In a reference voltage circuit 1*a* a diode D2 is added to the configuration of FIG. 1. The diode D2 includes an anode connected to the output terminal To of the current mirror circuit 10, and a cathode connected to the one end of the resistor 31. In a case where the voltage drop of the diode D2 is $V_{D2}$, the output voltage Vout is given by Equation (6) below.

$$V\text{out}=(R_{32}\cdot(V_Z-V_{D2})+R_{31}\cdot V_D)/(R_{31}+R_{32}) \quad (6)$$

Through addition of the diode D2, the voltage at the one end of the resistor 31 connected to the cathode of the diode D2 has a positive temperature coefficient because the anode voltage of the diode D2 has a negative temperature coefficient. The voltage at the one end of the resistor 31 thus changes in accordance with the temperature change.

Since the voltage at the one end of the resistor 31 has a positive temperature coefficient, in order to eliminate the temperature dependence of the output voltage Vout, the resistance $R_{31}$ of the resistor 31 is increased, as is understood from Equation (6). As a result, the voltage drop of the resistor 31 increases, and the output voltage Vout decreases.

Thus, as compared to the configuration of FIG. 1, in a case where a lower output voltage Vout is required, as illustrated in FIG. 3, the lower output voltage Vout can be easily obtained by adding the diode D2. Additionally, the diode D2 can be added in a same position (i.e., between the resistor 31 (first resistor) and a node where the Zener diode ZD is connected to the current source 10 or 10A) in the embodiments illustrated in at least FIG. 4 and FIG. 5, discussed below.

Further, as illustrated in FIG. 3, there may be employed a configuration in which any one of constant current sources 41 and 42 is added.

For example, by the addition of the constant current source 41 to the cathode of the Zener diode ZD, the Zener diode ZD is supplied with the current $I_{ZD}$ from the constant current source 41. As a result, the current mirror circuit 10 supplies the reference current $I_{crt}$ as the current $I_{D1}$ flowing through the diode D1. In this case, the current $I_{ZD}$ flowing through the Zener diode ZD is not affected by the voltage $V_D$, and the current control circuit 20 compensates only the current $I_{D1}$ flowing through the diode D1 in accordance with the temperature change.

The V/I conversion element 22 thus has, for example, a configuration including only the diode 22A illustrated in FIG. 2, and is configured to apply the voltage $V_D$ to the inverting input terminal of the error amplifier circuit OP1 in response to the voltage drop to that of the diode D1.

Further, also in a case where the constant current source 42 is added to the input terminal Ti of the current mirror circuit 10, similarly to the above-mentioned case in which the constant current source 41 is added, the current control circuit 20 compensates only the current $I_{D1}$ flowing through the diode D1.

Second Embodiment

Figure 4:
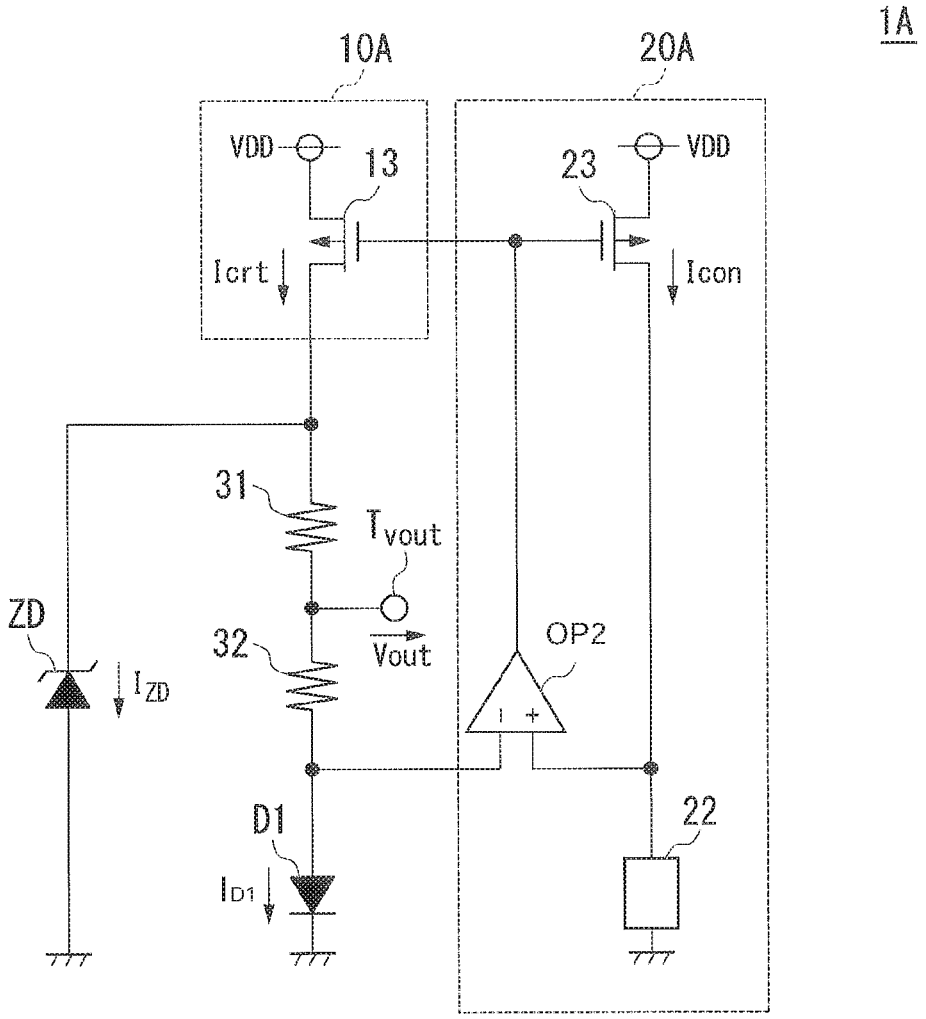
FIG. 4 is a circuit diagram illustrating a configuration example of a reference voltage circuit according to a second embodiment of the present invention.

FIG. 4 is a circuit diagram illustrating a configuration example of a reference voltage circuit according to the second embodiment of the present invention.

A reference voltage circuit 1A includes a current source 10A, a current control circuit 20A, resistors 31 and 32, a Zener diode ZD, and a diode D1.

The current source 10A includes a p-channel transistor 13.

The current control circuit 20A includes an error amplifier circuit OP2, a V/I conversion element 22, and a transistor 23.

The transistor 13 includes a source to which a power supply voltage VDD is applied, a gate connected to the output terminal of the error amplifier circuit OP2 and the gate of the transistor 23, and a drain connected to the cathode of the Zener diode ZD and one end of the resistor 31.

The transistor 23 is a p-channel transistor. The transistor 23 includes a source to which the power supply voltage VDD is applied, and a drain connected to one end of the V/I conversion element 22 and the non-inverting input terminal of the error amplifier circuit OP2.

The V/I conversion element 22 has another end connected to the ground point.

The resistor 31 has another end connected to the output terminal Tvout and one end of the resistor 32.

The resistor 32 has another end connected to the anode of the diode D1 and the inverting input terminal of the error amplifier circuit OP2.

The anode of the Zener diode ZD is connected to the ground point.

The cathode of the diode D1 is connected to the ground point.

The current control circuit 20A functions as a V/I converter circuit to convert a voltage $V_D$ of the diode D1 into a control current $I_{con}$ corresponding to the voltage $V_D$.

The voltage drop of the V/I conversion element 22 is substantially equal to the voltage $V_D$ of the diode D1 due to the negative feedback of the transistor 23 because the error amplifier circuit OP2 and the transistor 23 form a voltage follower.

Thus, through the V/I conversion element 22, the control current $I_{con}$ flows through the transistor 23 as a current corresponding to the voltage $V_D$ of the diode D1.

A drain current corresponding to the aspect ratio flows through each of the transistors 13 and 23 because the transistors 13 and 23 have the same gate voltage. As a result, a reference current $I_{crt}$ corresponding to the control current $I_{con}$ flowing through the V/I conversion element 22 flows through the transistor 13.

As described above, similarly to the first embodiment, the reference voltage circuit according to the second embodiment generates the control current $I_{con}$ from the anode voltage $V_D$ varying depending on the temperature change, to thereby supply, in accordance with the control current $I_{con}$, the reference current $I_{crt}$ which is a combined current of the current $I_{D1}$ flowing through the diode D1 and the current $I_{ZD}$ flowing through the Zener diode ZD, from the transistor 13.

Since the reference voltage circuit according to the second embodiment is capable of supplying the current $I_{ZD}$ in accordance with the temperature change with the current $I_{ZD}$ which is adjusted to the minimum necessary current amount, the reference voltage circuit is thus capable of saving power while maintaining the linearity of the temperature dependence of the voltage $V_Z$ which is applied to the cathode of the Zener diode ZD.

Third Embodiment

Figure 5:
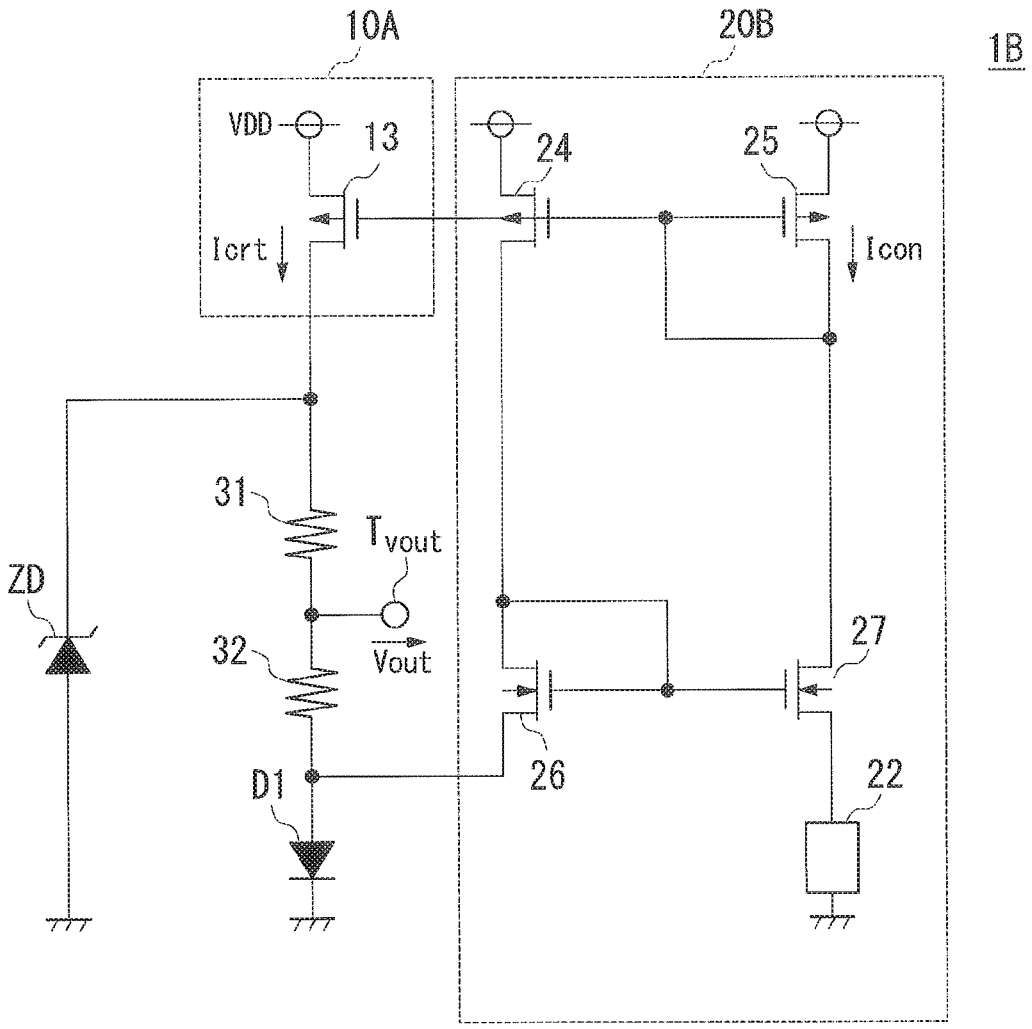
FIG. 5 is a circuit diagram illustrating a configuration example of a reference voltage circuit according to a third embodiment of the present invention.

FIG. 5 is a circuit diagram illustrating a configuration example of a reference voltage circuit according to the third embodiment of the present invention.

A reference voltage circuit 1B has a configuration similar to that of the second embodiment except that the reference voltage circuit 1B includes a current control circuit 20B.

The current control circuit 20B includes p-channel transistors 24 and 25, n-channel transistors 26 and 27, and a V/I conversion element 22.

The transistor 24 includes a source to which the power supply voltage VDD is applied, a gate connected to the gate and the drain of the transistor 25, and a drain connected to the drain and the gate of the transistor 26.

The transistor 25 includes a source to which the power supply voltage VDD is applied, and the drain connected to the drain of the transistor 27.

The transistor 26 includes the gate connected to the gate of the transistor 27, and a source connected to the anode of the diode D1.

The transistor 27 includes a source connected to the ground point through the V/I conversion element 22.

The current control circuit 20B functions as a V/I converter circuit to convert a voltage $V_D$ of the diode D1 into a control current $I_{con}$ corresponding to the voltage $V_D$.

The transistors 24 and 25 form a current mirror, and the current corresponding to a mirror ratio between the transistors 24 and 25 flows through each of the transistors 26 and 27 so as to determine the source voltage of the transistor 27.

For example, in a case where the mirror ratio between the transistors 24 and 25 is 1:1, and the transistors 26 and 27 have the same aspect ratio, the same drain current flows through each of the transistors 26 and 27. The source voltage (voltage $V_D$) of the transistor 26 thereby become equal the source voltage of the transistor 27. That is, the voltage drop of the V/I conversion element 22 becomes substantially equal to the voltage $V_D$.

Since the control current $I_{con}$ corresponding to the voltage $V_D$ flows through the V/I conversion element 22 via the transistor 25, a reference current $I_{crt}$ corresponding to the mirror ratio with respect to the control current $I_{con}$ flowing through the V/I conversion element 22 flows through the transistor 13 forming a current mirror with the transistor 25.

As described above, the reference voltage circuit 1B generates the control current $I_{con}$ based on the voltage $V_D$ varying depending on the temperature change, to thereby supply, in accordance with the control current $I_{con}$, the reference current $I_{crt}$ which is a combined current of the current $I_{D1}$ flowing through the diode D1 and the current $I_{ZD}$ flowing through the Zener diode ZD, from the transistor 13.

Since the reference voltage circuit 1B is capable of supplying the current $I_{ZD}$ in accordance with the temperature change with the current $I_{ZD}$ which is adjusted to the minimum necessary current amount, the reference voltage circuit 1B is thus capable of saving power while maintaining the linearity of the temperature dependence of the voltage $V_Z$ applied to the cathode of the Zener diode ZD.

Fourth Embodiment

Figure 6:
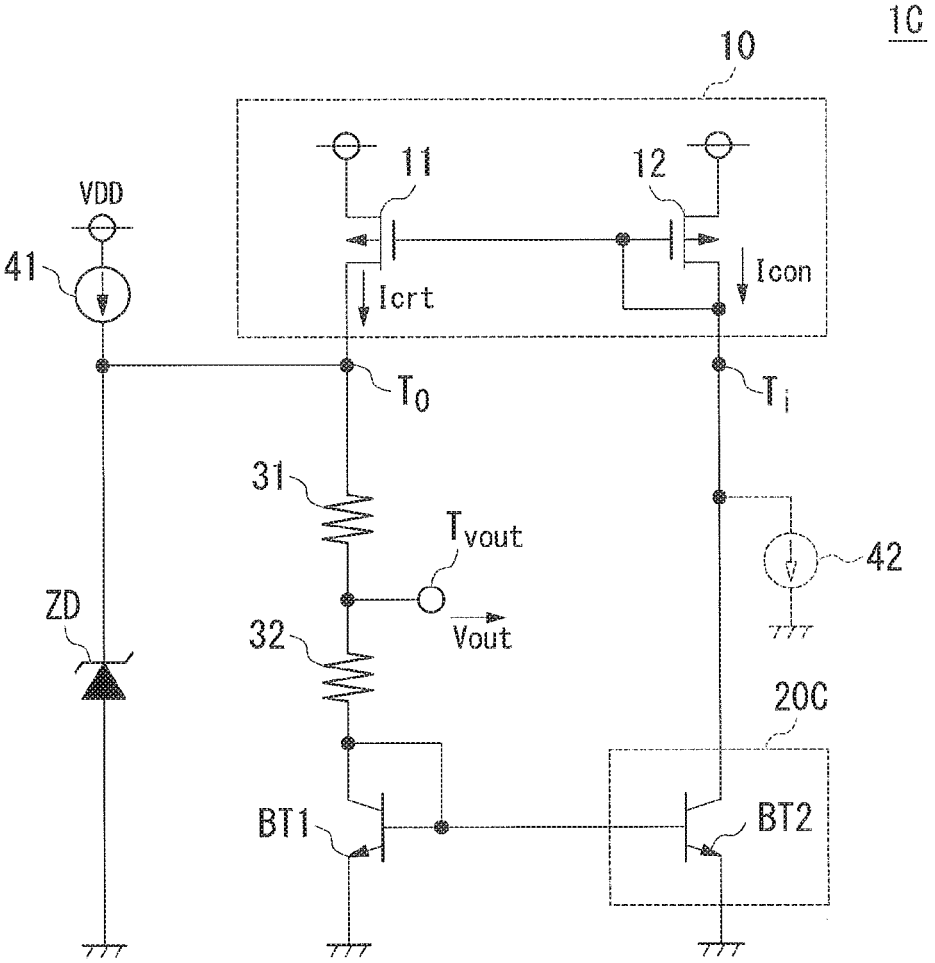
FIG. 6 is a circuit diagram illustrating a configuration example of a reference voltage circuit according to a fourth embodiment of the present invention.
Figure 7:
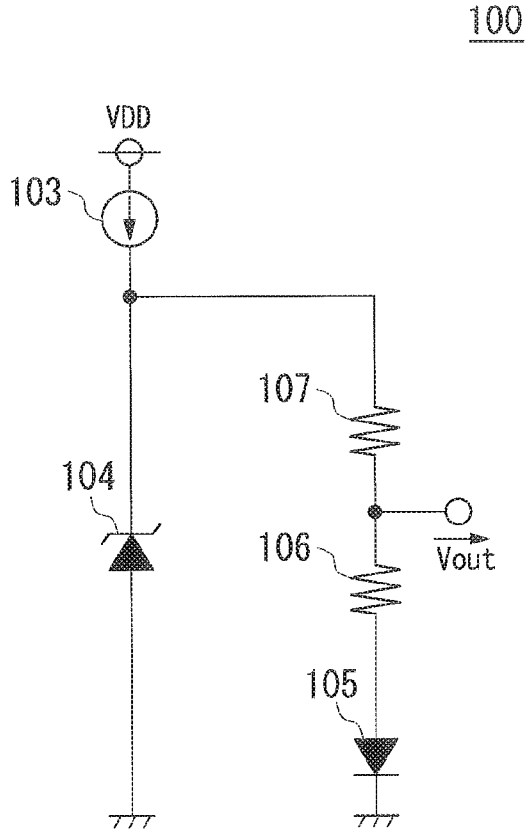
PRIOR ART FIG. 7
FIG. 7 is a circuit diagram illustrating a conventional reference voltage circuit.

FIG. 6 is a circuit diagram illustrating a configuration example of a reference voltage circuit according to the fourth embodiment of the present invention.

A reference voltage circuit 1C has a configuration similar to that of the first embodiment except that the reference voltage circuit 1C includes a current control circuit 20C, a bipolar transistor BT1, and a constant current source 41.

The current control circuit 20C includes a bipolar transistor BT2.

The bipolar transistors BT1 and BT2 are npn-type bipolar transistors and form a current mirror.

The bipolar transistor BT1 includes a collector connected to a base of the bipolar transistor BT1 and the other end of the resistor 32, and an emitter connected to the ground point. That is, the bipolar transistor BT1 corresponds to the diode D1 in the first embodiment.

The bipolar transistor BT2 includes a collector connected to the input terminal Ti of the current mirror circuit 10, a base connected to the base of the bipolar transistor BT1, and an emitter connected to the ground point. In this case, the base or the emitter of the bipolar transistor BT2 corresponds to the diode 22A of the V/I conversion element 22 in the first embodiment and has a diode characteristic similar to that of the base or the emitter of the bipolar transistor BT1.

In the bipolar transistor BT1, when the voltage $V_D$ is applied to the base, the base current flows corresponding to the voltage $V_D$, and a collector current (current $I_{D1}$) corresponding to the base current flows.

Through the bipolar transistor BT2, a collector current flows based on the mirror ratio between the bipolar transistor BT2 and the bipolar transistor BT1.

The collector current of the bipolar transistor BT2 is a control current $I_{con}$ flowing in accordance with the voltage $V_D$ and is supplied to the input terminal Ti of the current mirror circuit 10.

The current mirror circuit 10 thereby supplies the reference current $I_{crt}$ corresponding to the mirror ratio from the output terminal To.

Here, when the mirror ratio of the current mirror circuit 10 is 1:1, and the mirror ratio between the bipolar transistors BT1 and BT2 is 1:1, the reference current $I_{crt}$ supplied from the output terminal of the current mirror circuit 10 becomes substantially equal to the current $I_{D1}$.

Since the current $I_{ZD}$ flowing through the Zener diode ZD is thus supplied from the constant current source 41 and is not affected by the voltage $V_D$, the current control circuit 20C compensates only the current $I_{D1}$ flowing through the diode D1 at the bipolar transistor BT1.

Further, also in a case where the constant current source 42 is added to the input terminal Ti of the current mirror circuit 10, similarly to the above-mentioned case in which the constant current source 41 is added, the current control circuit 20C compensates only the current $I_{D1}$ flowing through the bipolar transistor BT1 (corresponding to the diode D1) in which the collector and the base are connected.

As described above, the reference voltage circuit 1C is configured to generate the control current $I_{con}$ corresponding to the voltage $V_D$ in the diode connection of the bipolar transistor BT1, to thereby cause, in accordance with the control current $I_{con}$, the reference current $I_{crt}$ to flow from the transistor 13 to adjust the current $I_{D1}$ in accordance with the temperature change.

Thus, since the reference voltage circuit 1C is capable of supplying the current $I_{ZD}$ in accordance with the temperature change with the current $I_{ZD}$ being adjusted to the minimum necessary current amount, the reference voltage circuit 1C is capable of saving power while maintaining the linearity of the temperature dependence of the voltage $V_Z$ to be applied to the cathode of the Zener diode ZD.

The embodiments of the present invention have been described above in detail with reference to the drawings. However, specific configurations of the present invention are not limited to the embodiments and encompass designs, modifications, and the like without departing from the gist of the present invention.

What is claimed is:

1. A reference voltage circuit, comprising:

a Zener diode having a cathode directly connected to a current source via a first node, the cathode of the Zener diode directly connected to the first node, and an anode directly connected to a ground point;

a first resistor having one end directly connected to the first node;

a second resistor having one end connected to another end of the first resistor;

a first diode having an anode connected to another end of the second resistor via a second node, the anode of the first diode and the another end of the second resistor directly connected to the second node, and a cathode connected to the ground point; and a current control circuit configured to generate a control current corresponding to an anode voltage of the first diode so that the current source supplies a reference current corresponding to the control current to the first diode, wherein the current control circuit comprises an error amplifier circuit having an input terminal directly connected to the second node.

2. The reference voltage circuit according to claim 1, wherein the current source comprises a current mirror circuit configured to receive the control current as an input current and supply the reference current as an output current, and wherein the current control circuit comprises a V/I conversion element configured to convert the anode voltage into the control current.

3. The reference voltage circuit according to claim 2, wherein the current control circuit comprises:

the error amplifier circuit having a non-inverting input terminal directly connected to the second node, and an inverting input terminal connected to one end of the V/I conversion element; and a first transistor of an n-channel type having a drain connected to an input terminal of the current mirror circuit, a gate connected to an output terminal of the error amplifier circuit, and a source connected to the one end of the V/I conversion element.

4. The reference voltage circuit according to claim 1, wherein the current source comprises a second transistor of a p-channel type having a source connected to a power supply, and a drain directly connected to the first node, and wherein the current control circuit is configured to control the second transistor so that the reference current corresponding to the control current flows.

5. The reference voltage circuit according to claim 4, wherein the current control circuit comprises:

a third transistor of a p-channel type having a source connected to the power supply;

the error amplifier circuit having an inverting input terminal directly connected to the second node, a non-inverting input terminal directly connected to a drain of the third transistor, and an output terminal directly connected to a gate of the second transistor and a gate of the third transistor; and a V/I conversion element connected between the non-inverting input terminal and the ground point, the V/I conversion element having substantially a same characteristic as a characteristic of the first diode.

6. A reference voltage circuit, comprising:

a Zener diode having a cathode connected to a current source via a first node, the cathode of the Zener diode directly connected to the first node, and an anode directly connected to a ground point;

a first resistor having one end connected to the first node;

a second resistor having one end connected to another end of the first resistor;

a first diode having an anode connected to another end of the second resistor via a second node, the anode of the first diode and the another end of the second resistor directly connected to the second node, and a cathode connected to the ground point; and a current control circuit configured to generate a control current corresponding to an anode voltage of the first diode so that the current source supplies, to the first diode, a reference current corresponding to the control current, wherein the current control circuit comprises:

a current mirror circuit;

a fourth transistor of an n-channel type having a drain connected to an input terminal of the current mirror circuit;

a fifth transistor of an n-channel type having a drain and a gate directly connected to each other, to an output terminal of the current mirror and to a gate of the fourth transistor, and a source directly connected to the second node; and a V/I conversion element connected between a source of the fourth transistor and the ground point, the V/I conversion element having substantially a same characteristic as a characteristic of the first diode, wherein the current source comprises a second transistor of a p-channel type having a source connected to a power supply, and a drain connected to the first node, and wherein the current control circuit is configured to control the second transistor so that the reference current corresponding to the control current flows.

7. The reference voltage circuit according to claim 1, further comprising a fourth diode connected in a forward direction between the first node and the first resistor.

8. The reference voltage circuit according to claim 2, further comprising a fourth diode connected in a forward direction between the first node and the first resistor.

9. The reference voltage circuit according to claim 4, further comprising a fourth diode connected in a forward direction between the first node and the first resistor.

10. The reference voltage circuit according to claim 3, wherein the V/I conversion element comprises a second diode having substantially a same characteristic as a characteristic of the first diode.

11. The reference voltage circuit according to claim 3, wherein the V/I conversion element comprises a second diode, a third resistor, and a series circuit in which a fourth resistor and a third diode are connected in series, wherein the second diode, the third resistor, and the series circuit together form a parallel circuit.

12. The reference voltage circuit according to claim 3, further comprising a fourth diode connected in a forward direction between the first node and the first resistor.

13. The reference voltage circuit according to claim 5, wherein the V/I conversion element comprises a second diode having substantially a same characteristic as a characteristic of the first diode.

14. The reference voltage circuit according to claim 5, wherein the V/I conversion element comprises a second diode, a third resistor, and a series circuit in which a fourth resistor and a third diode are connected in series, wherein the second diode, the third resistor, and the series circuit together form a parallel circuit.

15. The reference voltage circuit according to claim 5, further comprising a fourth diode connected in a forward direction between the first node and the first resistor.

16. The reference voltage circuit according to claim 6, wherein the V/I conversion element comprises a second diode having substantially a same characteristic as a characteristic of the first diode.

17. The reference voltage circuit according to claim 6, wherein the V/I conversion element comprises a second diode, a third resistor, and a series circuit in which a fourth resistor and a third diode are connected in series, wherein the second diode, the third resistor, and the series circuit together form a parallel circuit.

18. The reference voltage circuit according to claim 6, further comprising a fourth diode connected in a forward direction between the first node and the first resistor.

19. A reference voltage circuit, comprising:

a Zener diode having a cathode connected to a current source via a first node, the cathode of the Zener diode directly connected to the first node, and an anode directly connected to a ground point;

a first resistor having one end connected to the first node;

a second resistor having one end connected to another end of the first resistor, wherein a connection between the one end of the second resistor and the another end of the first resistor is an output of the reference voltage circuit and outputs a reference voltage output of the reference voltage circuit;

a first diode having an anode connected to another end of the second resistor via a second node, the anode of the first diode and the another end of the second resistor directly connected to the second node, and a cathode connected to the ground point; and a current control circuit configured to generate a control current corresponding to an anode voltage of the first diode so that the current source supplies a reference current corresponding to the control current to the first diode, wherein the current source comprises:

a constant current source configured to supply a current flowing through the Zener diode; and a current mirror circuit having an output terminal directly connected to the first node, wherein the first diode is formed of a first bipolar transistor of an npn type having a collector connected to a base, and an emitter connected to the ground point, wherein the current control circuit comprises a second bipolar transistor of an npn type having a collector connected to an input terminal of the current mirror circuit, a base of the second bipolar transistor directly connected to the collector and the base of the first bipolar transistor, and an emitter connected to the ground point, and wherein the current mirror circuit is configured to receive the control current as an input current and supply the reference current as an output current.

20. The reference voltage circuit according to claim 19, wherein the first bipolar transistor has substantially a same base-emitter diode characteristic as a base-emitter diode characteristic of the second bipolar transistor.

* * * * *